US006538570B1

(12) United States Patent
Smith

(10) Patent No.: US 6,538,570 B1
(45) Date of Patent: Mar. 25, 2003

(54) GLASS-BREAK DETECTOR AND METHOD OF ALARM DISCRIMINATION

(75) Inventor: Richard A. Smith, El Dorado Hills, CA (US)

(73) Assignee: Honeywell International, Morristown, NJ (US)

( * ) Notice: Subject to any disclaimer, the term of this patent is extended or adjusted under 35 U.S.C. 154(b) by 144 days.

(21) Appl. No.: 09/602,647

(22) Filed: Jun. 22, 2000

Related U.S. Application Data

(63) Continuation of application No. PCT/US00/12429, filed on May 5, 2000.
(60) Provisional application No. 60/133,203, filed on May 7, 1999.

(51) Int. Cl.[7] ..... G08B 13/00
(52) U.S. Cl. ..... 340/550; 340/566
(58) Field of Search ..... 340/550, 566, 340/541, 540, 544

(56) References Cited

U.S. PATENT DOCUMENTS

| | | | | |
|---|---|---|---|---|
| 3,074,053 | A | 1/1963 | McDonough et al. | 340/522 |
| 3,242,486 | A | 3/1966 | Corbell | 342/28 |
| 3,573,817 | A | 4/1971 | Akers | 340/522 |
| 3,634,846 | A | 1/1972 | Fogiel | 340/521 |
| 3,725,888 | A | 4/1973 | Solomon | 340/522 |
| 3,801,978 | A | 4/1974 | Gershberg et al. | 340/516 |
| 3,889,250 | A | 6/1975 | Solomon | 340/540 |
| 3,946,377 | A | 3/1976 | Zetting | 340/550 |
| 3,967,283 | A | 6/1976 | Clark et al. | 342/28 |
| 3,979,740 | A | 9/1976 | Forbat et al. | 340/512 |
| 4,054,867 | A | 10/1977 | Owens | 340/550 |
| 4,088,989 | A | 5/1978 | Solomon | 340/506 |
| 4,091,660 | A | 5/1978 | Yanagi | 73/658 |
| 4,112,420 | A | 9/1978 | Mifune et al. | 340/550 |
| 4,117,464 | A | 9/1978 | Lutz | 340/554 |
| 4,134,109 | A | 1/1979 | McCormick et al. | 340/550 |
| 4,142,188 | A | 2/1979 | Zetting et al. | 367/93 |
| 4,180,811 | A | 12/1979 | Yoshimura et al. | 340/566 |
| 4,222,041 | A | 9/1980 | Von Tomkewitsch et al. | 340/517 |
| 4,225,859 | A | 9/1980 | Zetting et al. | 340/566 |
| 4,307,387 | A | 12/1981 | Baxendale | 340/566 |
| 4,342,987 | A | 8/1982 | Rossin | 340/567 |
| 4,364,030 | A | 12/1982 | Rossin | 340/567 |
| 4,377,808 | A | 3/1983 | Kao | 340/527 |
| 4,401,976 | A | 8/1983 | Stadelmayr | 340/522 |
| 4,410,884 | A | 10/1983 | Heiland | 340/541 |
| 4,437,089 | A | 3/1984 | Achard | 340/541 |
| 4,468,657 | A | 8/1984 | Rossin | 340/555 |
| 4,468,658 | A | 8/1984 | Rossin | 340/567 |
| 4,482,889 | A | 11/1984 | Tsuda et al. | 340/514 |

(List continued on next page.)

FOREIGN PATENT DOCUMENTS

| | | |
|---|---|---|
| AU | 664132 | 1/1994 |
| EP | A-0 141 987 A3 | 9/1984 |
| EP | A-0 487 358 A1 | 5/1992 |
| FR | 2 731 541 | 9/1996 |

OTHER PUBLICATIONS

FG–1015/1025/1025R Glassbreak Detectors, C&K Systems datasheet, 1998.

*Primary Examiner*—Daniel J. Wu
*Assistant Examiner*—Sihong Huang
(74) *Attorney, Agent, or Firm*—John P. O'Banion

(57) ABSTRACT

A glass-breakage detector that provides improved immunity to false triggering when detecting the breakage of a glass window, or similar structure, as sensed by an acoustic transducer. The detector employs a validation method which improves discrimination of commonly known false alarm signals, such as glass flexing. Signals from an acoustic transducer are amplified, conditioned, and measured within three signal processing sections which process the signals at low-frequencies, medium-frequencies, and high-frequencies according to methods highly selective to breakage events. The detector provides an alarm output upon validating a detected breakage event.

70 Claims, 6 Drawing Sheets

U.S. PATENT DOCUMENTS

| | | | | | |
|---|---|---|---|---|---|
| 4,611,197 | A | | 9/1986 | Sansky | 340/522 |
| 4,625,199 | A | | 11/1986 | Pantus | 340/522 |
| 4,660,024 | A | | 4/1987 | McMaster | 340/522 |
| 4,668,941 | A | | 5/1987 | Davenport et al. | 340/550 |
| 4,710,750 | A | | 12/1987 | Johnson | 340/522 |
| 4,772,875 | A | | 9/1988 | Maddox et al. | 340/522 |
| 4,837,558 | A | | 6/1989 | Abel et al. | 340/550 |
| 4,845,464 | A | | 7/1989 | Drori et al. | 340/429 |
| 4,853,677 | A | | 8/1989 | Yarbrough et al. | 340/544 |
| 4,882,567 | A | | 11/1989 | Johnson | 340/522 |
| 4,928,085 | A | | 5/1990 | DuRand, III et al. | 340/544 |
| 4,970,517 | A | * | 11/1990 | Williams | 340/552 |
| 4,991,145 | A | | 2/1991 | Goldstein et al. | 367/94 |
| 5,023,593 | A | | 6/1991 | Brox | 340/522 |
| 5,057,817 | A | | 10/1991 | Berube | 340/506 |
| 5,077,548 | A | | 12/1991 | Dipoala | 340/522 |
| 5,107,249 | A | | 4/1992 | Johnson | 340/541 |
| 5,117,220 | A | | 5/1992 | Marino et al. | 340/550 |
| 5,164,703 | A | | 11/1992 | Rickman | 340/515 |
| 5,185,593 | A | | 2/1993 | DuRand, III et al. | 340/544 |
| 5,192,931 | A | | 3/1993 | Smith et al. | 340/550 |
| 5,276,427 | A | | 1/1994 | Peterson | 340/522 |
| 5,323,141 | A | | 6/1994 | Petek | 340/566 |
| RE34,788 | E | | 11/1994 | DuRand, III et al. | 340/550 |
| 5,376,919 | A | | 12/1994 | Rickman | 340/544 |
| 5,438,317 | A | | 8/1995 | McMaster | 340/550 |
| 5,450,061 | A | | 9/1995 | McMaster | 340/550 |
| 5,471,195 | A | | 11/1995 | Rickman | 340/550 |
| 5,475,365 | A | | 12/1995 | Hoseit et al. | 340/522 |
| 5,510,767 | A | | 4/1996 | Smith | 340/566 |
| 5,515,029 | A | | 5/1996 | Zhevelev et al. | 340/544 |
| 5,543,783 | A | | 8/1996 | Clark et al. | 340/550 |
| 5,552,770 | A | | 9/1996 | McMaster | 340/550 |
| 5,675,320 | A | | 10/1997 | Cecic et al. | 340/566 |
| 5,796,336 | A | | 8/1998 | Ishino et al. | 34/566 |
| 6,130,602 | A | * | 10/2000 | O'Toole et al. | 340/10.33 |
| 6,272,411 | B1 | * | 8/2001 | Corrado et al. | 180/271 |

* cited by examiner

GLASS-BREAK DETECTOR AND METHOD OF ALARM DISCRIMINATION

CROSS-REFERENCE TO RELATED APPLICATIONS

This application claims priority from, and is a continuation of, co-pending PCT international application serial number PCT/US00/12429 filed on May 5, 2000, which designates the U.S. and which claims priority from U.S. provisional application Ser. No. 60/133,203 filed on May 7, 1999. Both applications are incorporated herein by reference.

STATEMENT REGARDING FEDERALLY SPONSORED RESEARCH OR DEVELOPMENT

Not Applicable

REFERENCE TO A MICROFICHE APPENDIX

Not Applicable

NOTICE OF MATERIAL SUBJECT TO COPYRIGHT PROTECTION

Portions of the material in this patent document are subject to copyright protection under the copyright laws of the United States and of other countries. The owner of the copyright has no objection to the facsimile reproduction by anyone of the patent document or the patent disclosure, as it appears in the United States Patent and Trademark Office file or records, but otherwise reserves all copyrights whatsoever.

BACKGROUND OF THE INVENTION

1. Field of the Invention

The invention relates generally to acoustical sensing of glass-breakage, and specifically to providing electronic glass-break detection having improved discrimination of glass flexing to reduce false triggering.

2. Description of the Background Art

The detection of glass-breakage events by sensing and processing acoustical waves which are the result of a contact force being applied to a contact-sensitive-surface is well known in the art. In a few alarm systems, glass-breakage has additionally been detected as a flex pressure wave followed by high-frequency breakage acoustics. Although these methods provide a measure of breakage discrimination they are unable to discriminate numerous non-glass-breakage events, such as impact and laminated glass acoustic patterns, typically exemplified by type 1 and type 2 impact events which are similar to impacts defined by Underwriters Laboratory of Canada (ULC).

Therefore, a need exists for a glass-breakage detection circuitry that provides for proper discrimination of non-glass-breakage events as detected by an acoustical transducer. The present invention satisfies those needs, as well as others, and overcomes the deficiencies of previously developed discrimination circuits.

BRIEF SUMMARY OF THE INVENTION

The present invention is capable of providing increased discrimination of impacts which do not cause panel breakage. The detection method and system of the invention provides improved discrimination of breakage events and thereby reduces triggering of false alarms. Acoustical signals generated by an event are processed in real-time according to a method of validation that is highly selective to actual breakage events while discriminating against glass-flexure and other common non-glass-breakage events.

An object of the invention is to improve false trigger immunity when detecting breakage events acoustically.

Another object of the invention is to provide a dual-trigger method that prevents the errant triggering of an acoustical event.

Another object of the invention is to provide false trigger immunity from glass-flexing events, such as type 1 and type 2 vibrations resulting from an impact in which the glass does not break.

Another object of the invention is to provide alarm detection of breakage events within laminated windows and similar laminated structures while differentiating similar characteristics of non-breakage events within non-laminated structures.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which re for illustrative purposes only.

DETAILED DESCRIPTION OF THE INVENTION

Referring more specifically to the drawings for illustrative purposes, a preferred embodiment of the glass-breakage detector employing a highly-selective method of glass flex discrimination is embodied in the apparatus generally shown in FIG. 1 through FIG. 10. It will be appreciated that the apparatus may vary as to configuration and as to details of the parts without departing from the basic concepts as disclosed herein.

1. Overview

The acoustic detection circuit and method of the present invention provides improved discrimination of common non-glass-breakage events to reduce false alarms. Alarm systems are typified within the industry as described within U.S. Pat. No. 5,192,931 issued Mar. 9, 1993 to Smith et al., U.S. Pat. No. 5,510,767 issued Apr. 23, 1996 to Smith, and U.S. Pat. No. 5,471,195 issued Nov. 28, 1995 to Rickman, which are incorporated herein by reference."

Figure 1:
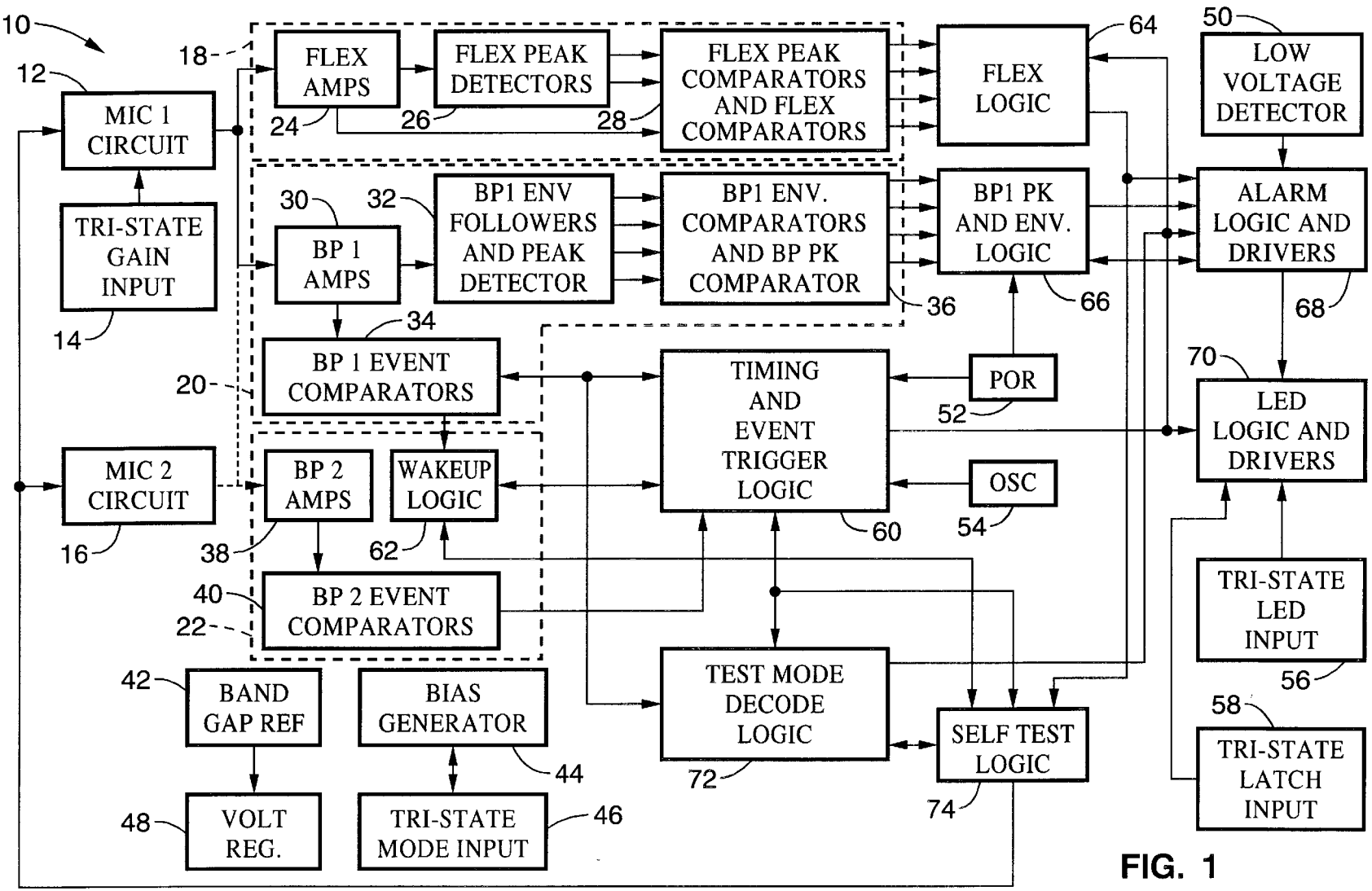
FIG. 1 is a block diagram of system electronics within the glass-breakage detector system according to the present invention.

FIG. 1 is an embodiment of the glass-breakage detector electronics 10. The glass-breakage detector may be utilized within a variety of both hardwired and wireless alarm applications. Typically, the glass-breakage detector is employed for sensing the breakage of glass windows and the embodiment described is configured with threshold and timing values specific for the detection of framed-glass panel breakage. By adjusting the detection parameters, the present invention may alternatively be utilized for detecting numerous forms of shattered panel breakage that can occur as a result of a sufficient contact force being applied to a contact-sensitive panel surface. Therefore, the present invention is not to be considered limited in use to the sensing of glass-breakage.

FIG. 1 shows an embodiment of the glass-breakage detector circuit 10 as a mixed signal analog-digital ASIC providing real-time parallel event processing in both the analog and digital domains. Due to the often harsh environment of alarm system applications, each of the input and output pins of the ASIC preferably has at least 2 kV of ESD (Electro-Static Discharge) protection. It will be appreciated that alternative embodiments may be implemented utilizing a variety of electronic design forms, without departing from the underlying inventive principles.

Numerous acronyms are used in the following text which are explained within the body of the description, a summary listing of acronyms is provided for reference in Table 1.

2. Description of Analog Functions within the Circuit

Referring to the glass-breakage detector circuit 10 of FIG. 1, an acoustic transducer, such as a microphone (not shown), is received as input by a front end buffer of a first microphone input circuit 12. The first microphone input circuit 12 preferably comprises a means for scaling the microphone input, exemplified herein as a rail-to-rail buffer amplifier which includes a small network of switched capacitors parallel to the microphone input to allow for trimming of the microphone sensitivity.

Microphone sensitivity is set by a tri-state gain input 14, which is provided as an external signal to the ASIC. The gain control configures the inputs to achieve narrow sensitivity variation over a wide range of microphones. The three preferred attenuation states are: non-attenuated, a first level of attenuation nominally providing 1.6–2.0 dB of attenuation, and a second level of attenuation nominally providing 3.5–4.0 dB of attenuation; these values are also summarized in Table 2.

The input from an optional second acoustic transducer (not shown) may additionally be provided for improving discrimination of non-glass-breakage events by picking up a "back" transducer signal to allow performing "time of arrival" signal processing, which is described in detail within U.S. Pat. No. 5,471,195 by Rickman. The second transducer is input to a second microphone circuit 16 which contains a signal amplifier and conditioning circuitry.

The acoustical signal from the first microphone circuit 12 is processed by frequency-selective signal processing sections that each process components of the acoustical signal that exists within a specific pass-band and that are shown surrounded by a dashed line within FIG. 1, comprising a low-frequency section 18, medium-frequency section 20, and optionally a high-frequency section 22.

Figure 2:
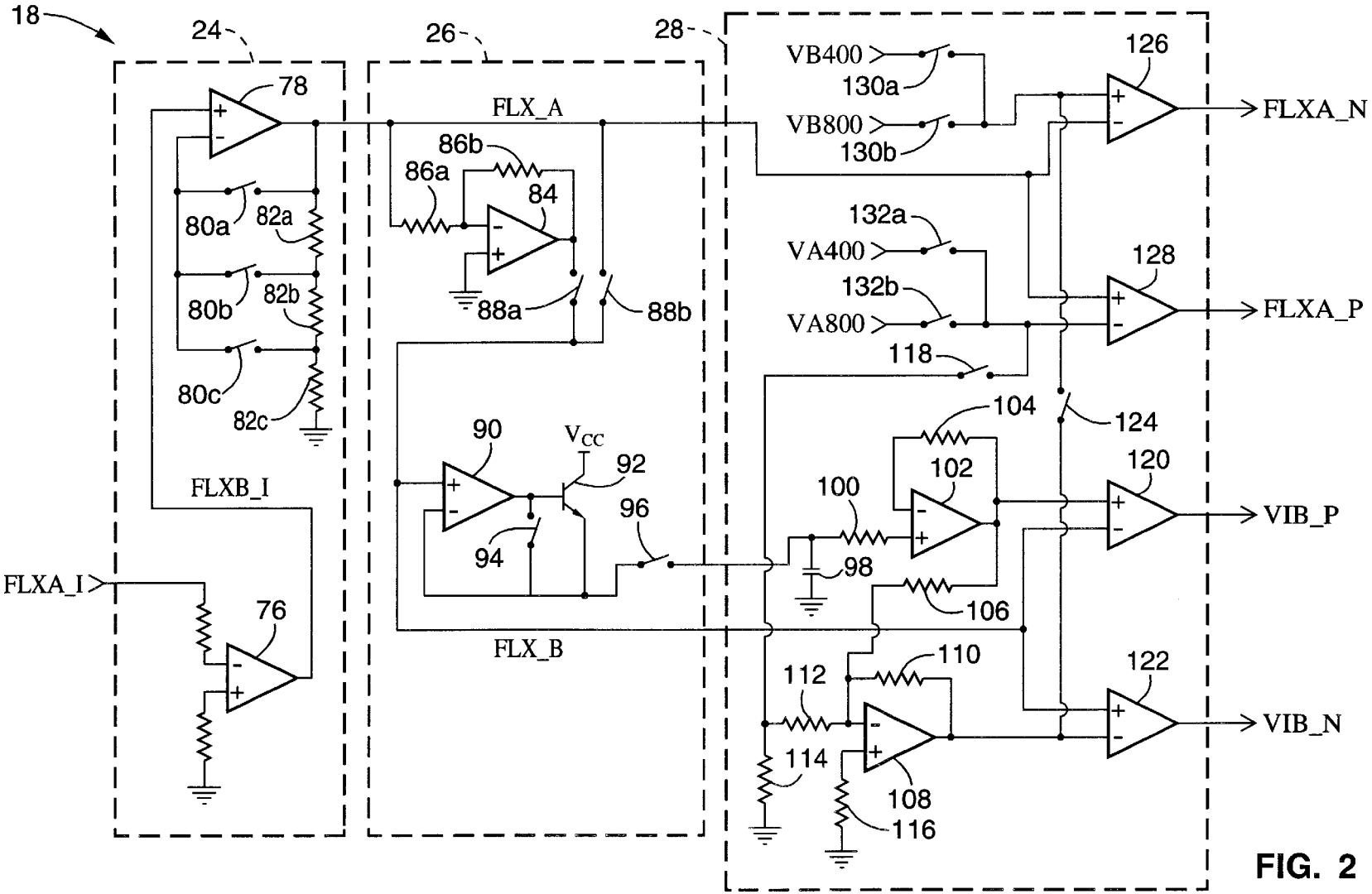
FIG. 2 is a simplified schematic of the low-frequency signal processing section within FIG. 1.

The low-frequency signal processing section 18 in combination with the flex logic 64, processes the low frequencies generally associated with the flexing of a panel of material, such as a glass window, and therefore is also referred to as the "flex" circuit. Signal processing section 18 comprises flex circuit amplifiers 24, flex peak detectors 26, and comparators for flex and flex peak 28. FIG. 2 is a simplified schematic, provided by way of example and not of limitation, which illustrates the primary circuit elements and various analog switching within an embodiment of the low-frequency signal processing section 18 of FIG. 1.

Referring to FIG. 2, the flex circuit amplifiers 24 provide amplification and active low-frequency filtering of the signals from the first microphone circuit. Amplifier 76 provides amplification and active low-frequency filtering of the first microphone signal FLXA¯I that is subsequently received by amplifier 78 which provides programmable gain as selected by switches 80*a*–80*c* on a ladder of feedback resistors 82*a*–82*c*.

The flex peak detector stage 26 stores the absolute value of the first flex peak. In order to detect this flex peak, a set of threshold signal levels are generated for positive and negative thresholds, while another stage provides storage of the peak, and a final stage inverts this signal when necessary to generate an absolute value of the flex peak. Specifically, the signal FLX_A is provided as a signal to an inverting amplifier 84 with feedback resistors 86*a*, 86*b*. *A peak detector circuit receives a signal FLX*_B which is provided through switches 88*a*, 88*b* as either the FLX_A signal, or the inversion of the FLX_A signal. The peak detector circuit comprises op-amp 90, bipolar transistor 92, switches 94, 96 and capacitor 98 on which the absolute value peak is stored.

The comparator section for flex and flex peak 28, provide for testing of numerous flex signal conditions. The positive and negative going flex signal can be compared against predetermined thresholds. The negative and positive flex signal phase relationships can be determined. A comparison of the flex signal in relation to the absolute value of the first flex peak may be provided. Referring to FIG. 2, op-amp 102 buffers the peak voltage stored on capacitor 98 through resistor 100 to create a direct-current signal by dividing resistors 104, 106 to provide a flex positive vibration threshold. Op-amp 108 is configured with resistors 110, 112, 114, 116, which invert and condition the direct-current signal from op-amp 102 for the negative threshold comparison. Switch 118 provides for the selection of threshold reference signals with the input to the inverting amplifier 108. Two comparators provide a bounded comparison of the flex signal, with comparator 120 detecting positive excursions above the established threshold, and comparator 122 detecting negative going excursions below the threshold. Switch 124 allows the signal output from comparator 108 to be selected as a third input threshold for comparator 126. Another set of comparators provide a bounded comparison of the flex signal relative to fixed thresholds, which enables the logic to determine the phase relationships of the event signals. Comparator 126 compares the FLX_A signal for negative excursion below threshold voltage signal VB400 or VB800; similarly comparator 128 compares FLX_A for a positive excursion above threshold voltage signals VA400 or VA800.

Referring again to FIG. 1, the medium and high-frequency signal processing sections will be described solely in reference to the block diagram of FIG. 1, as they contain similar analog circuitry as described for the low-frequency flex circuit whose internal circuitry was previously described in detail in reference to FIG.2.

The medium-frequency signal processing section 20, contains a band-pass filter with amplification 30 of mid-range acoustical frequencies. The band-pass envelope followers and peak detector 32, track band-pass average voltage (BAVA) and band-pass average peak (BAVA_PK). Internally, the band-pass envelope followers and peak detector may be implemented as one op-amp which provides the drive of BAV capacitance for the direct-current envelope (BAV) of the BP1 signal, while another op-amp section provides the voltage for peak detection of the BAV signal. A non-inverting op-amp is used as a buffer for direct-current attenuation of the BAVA_PK signal to establish a threshold for a duration determination for the BAV signal.

The BP1 band-pass event comparators 34, provide a mechanism for determining the beginning of an acoustic event. The glass-breakage detector is normally in a reset state wherein no discernable acoustic events are taking place. An acoustic event is considered to occur when the glass is moved by any force, such as wind, touch, or a hammer. Upon encountering an acoustic event, the glass-breakage detector validates the measured acoustical signals to determine if the event constitutes a breakage. BP1 event comparators 34 compare the medium-frequency band-pass acoustical signal with a predetermined threshold thereby allowing subsequent logic circuitry to determine the beginning of the event and the initial phase dominance of the constituent event signals. Upon event validation, the event comparator generates an event trigger which initiates event timing when it engages the wake up logic for circuitry which is in a low-power or sleep mode.

The BP1 band-pass envelope comparators and band-pass peak comparator 36, provide for measuring the band-pass average voltage (BAV) and the duration of the BP1 medium-frequency band-pass signal. The band-pass envelope comparator detects the BAV as it exceeds a preset threshold, thereby allowing the logic to determine the envelope characteristics of the BP1 signal. The band-pass envelope duration comparator detects the relationship of the BAV signal in relation to a threshold of BAVA_PK/10, which further enables the logic to determine the envelope duration of the BP1 signal.

The high-frequency signal processing section 22, may receive input from either the first microphone circuit 12, or the optional second microphone circuit 16, and provides a high-frequency band-pass BP2 amplifier 38. Typically, the BP2 amplifier 38 within the high-frequency signal processing section 22, is used for conditioning data from the first microphone circuit 12 if the system is not in "ZONE" mode, or optionally from the second microphone circuit 16 when "ZONE" mode is enabled.

A band-pass event comparator 40 provides a high-frequency event threshold comparison utilized in conjunction with BP1 event comparator 34 to provide dual-triggering of acoustical events to improve event recognition. Utilizing a pair of comparator circuits provides for the detection of high-frequency signal amplitudes, either positive or negative, in relation to the predetermined absolute threshold. The BP2 event comparator 40 provides an output which enables logic to determine the beginning of the event and a mechanism for providing the "time-of-arrival" determination when the device is in "ZONE" mode.

Additional analog circuits are preferably contained within the ASIC to provide numerous support functions. A bandgap reference 42 provides a fixed and stable voltage reference within the ASIC for biasing the op-amps and setting the relative thresholds of the comparators. The bandgap reference 42 is preferably comprised of a bandgap reference and three op-amps used for the creation of additional positive and negative voltages. The bandgap reference employed within this embodiment has a nominal voltage of 1.25 volts +/−5% and draws only sufficient current for maintaining a stable reference voltage.

Bias currents are supplied for the op-amp current mirrors by a controllable bias generator 44. The bias generator is preferably comprised of multiple transistors that translate the reference voltage into current which supplies the required current mirrors of the op-amps. A tri-state mode input 46 controls the mode of the bias generator 44, thereby allowing the bias voltage to be set according to the mode of the system. The three input states of the tri-state mode input are: a high state for setting "ZONE", a high-impedance state for setting normal sensitivity, and a low state for setting an input sensitivity reduction of 3–4 dB. These three modes of the tri-state input 46 are listed in Table 3.

Regulated power is supplied to the circuitry by means of the voltage regulator 48. The regulator circuit provides $V_{dd}$ regulation such that the regulated voltage is 5.5 volts +/−10% in hardwired mode, and 3.3 volts +/−10% in wireless mode. The voltage regulator has an output which controls a linear regulation transistor located off-chip, and a feedback sense input that senses the $V_{dd}$ from the regulated $V_{dd}$ provided by the off-chip regulation transistor. The voltage regulator is preferably comprised of an op-amp, configured as a voltage follower, and a voltage divider which divides down $V_{dd}$ for sense feedback. A low supply voltage detector 50, is incorporated within the ASIC to compare the actual $V_{dd}$ against a low voltage threshold, and to signal any significant excursion thereof. The low voltage threshold in the hardwired mode is set for 4.17 volts +/−10%, while the threshold in wireless mode is set for 2.8 volts +/−10%. Since the $V_{dd}$ voltage of the system may drop as a result of tampering, the low voltage detector signals to the alarm logic that a low voltage condition exists so that the supply voltage condition may be indicated.

A power-on-reset (POR) circuit 52 provides a simultaneous reset to circuit elements as a result of a power transition. The power-on-reset circuit 52 is split into two separate reset phases, the first of which is a $V_{dd}$ dependent power-on-reset, and the second is a time dependent POR. The $V_{dd}$ dependent POR starts up the voltage regulator and triggers the time dependent POR. The time dependent POR insures that logic circuits within the ASIC are held in reset for a sufficient duration to assure stabilization of analog circuitry before the system commences monitoring for acoustic events.

An oscillator circuit 54 provides a drive circuit for a quartz crystal timing element, and feedback to provide for stable oscillation thereof. The oscillator circuit, with the associated external crystal, generates the fundamental clock frequency of the ASIC upon which all circuit timing is based.

A tri-state LED enable input 56, controls the active states of the external LEDs driven by the ASIC. This external input has three input states: a high state which disables the LEDs, a low state with enables the LEDs, and a high-impedance state which enables setup processing or enabling of the LEDs. Table 4 lists the three states of the LED control input.

A tri-state latch input 58 provides external control of the latch status for the alarm LED and the selection of either hardwired, or wireless mode. The latch input has three states: a high state which selects non-latched LEDs in hardwired mode, a low state which selects latched LEDs in hardwired mode, and a high-impedance state which selects non-latching LEDs in wireless mode. Table 5 lists the three states of the latch control input.

3. Description of Digital Functions within the Circuit

Referring again to FIG. 1, the following describes the digital functions within the ASIC of this embodiment of the present invention. A timing section 60 provides for timing of events which occur subsequent to the event trigger. All events subsequent to the trigger are timed in relation to the event trigger. When an event trigger occurs, the processing within the ASIC is enabled for a fixed period of time (typically 156 ms) and measurements of time, which preferably provides at least twenty-four bits of resolution within the ASIC, are performed as referenced to the event trigger. If the ASIC is in "ZONE" mode, the timing section 60 additionally detects the time of arrival for both the "front" and "back" microphone signals in a priority fashion.

Another time related function is provided by the wake-up logic 62, which controls selection of low-power modes for the op-amps and comparators when no valid event trigger has been detected. After the event trigger occurs, the op-amps are awakened and kept awake by the wake-up logic only for a sufficient duration to allow stabilization of the op-amps and to allow performing the necessary signal amplification or conditioning. A logic low on the wake signal from the wake logic 62 causes the op-amps to enter the low-power, or sleep, mode.

The low-frequency signal processing section 18, processes the lower acoustic frequencies associated with panel flexing which are interpreted by a flex logic circuit 64.

Band-pass peak and band-pass averaging logic 66 provide for processing of the signals from the medium-frequency signal processing section 20. (The processing sections of the three frequency ranges follow processing methods which will be described subsequently.)

Alarm logic and drivers 68, carry out qualifying of the signals from all digital processing blocks at the end of the event processing time-window, or interval (approximately 31 milliseconds from valid event trigger), and generates the status of various alarm conditions. Logic and LED drivers 70, generate the signals for driving the status LEDs, which indicate the status of the system and preferably display: the event trigger, test mode, self-test status, alarm status, alarm memory status, trouble status, low battery status, and the flex signal amplitude. A number of rules determine the anticipated state of the LEDs within this preferred embodiment.

Active LEDs are modulated at high-frequency and low duty cycles to render a power savings. Multiple active LEDs are driven out of phase with one another (multiplexed) to reduce the peak power and reduce supply fluctuations. Alarm memory is recalled by an event detection, such as an audio verification which could be initiated for example by a hand clap. This alarm memory is preferably displayed on the red LED as a flash for about five seconds. The alarm memory is reset by the occurrence of a power-on-reset, a test mode activation, or a remote self-test request. The LEDs can be enabled or disabled remotely, and additionally may be controlled by a circuit tester connected to the ASIC when the devices are set into a "SMART" mode. An optional yellow LED indicates the presence of a low-frequency flex signal of sufficient amplitude. When the LEDs are disabled, they remain in an off state for all "Normal" conditions, yet are enabled for test mode. Table 6 lists the states for the LEDs within the glass-breakage detector;

The ASIC is preferably provided with test mode logic that facilitates testing of ASIC internals. Test mode decode logic 72, distinguishes activation codes sensed via the microphone input circuits. Upon successfully distinguishing an activation code, "Test Mode" is entered such that test processing can be performed for approximately five minutes. Alternatively, when in "SMART" mode; upon receipt of a valid activation code that occurs within two seconds after a valid code has been received to exit test mode, the LED states are toggled.

A broad spectrum of testing within the circuit is provided by self-test logic 74, which allows for driving of the microphone buffer inputs with a self-test pattern that is processed in the analog and digital sections. This self-test allows verification of analog and digital processing to assure normal circuit functionality. Upon self-test failure a trouble status indication is latched and displayed on the LEDs. The self-test failure is subsequently reset by exiting and entering test mode, or alternatively by resetting circuit power. Self-test is performed on power-up, and may additionally be initiated by an external input signal (not shown).

4. Description of Signal Processing Methods

This section describes two signal processing methods, "A" and "B", utilized within the ASIC for validation of breakage events. Methods "A" and "B" are based on various specific signal conditions, thresholds, and timing conditions which may exist within the ASIC during operation. The exemplified circuitry is matched with the timing and threshold parameters of the methods toward detection and discrimination which is optimized for framed glass-breakage events. Although specific times and thresholds are described for the embodiment, these do not in any way limit the breadth of the invention described; hardware, timing, and threshold variations can be supported without departing from the disclosed teachings.

In the normal processing mode of the present invention, a quiescent initial circuit state is assumed in which the timer and the event trigger are held in a reset mode. Timing within the integrated circuit is derived from a 32,768 Hz crystal-oscillator clock that maintains a rounded accuracy of +/−1 %. The gains and filter characteristics within the circuitry have been selected and tested empirically, by means of ASIC emulators, for each channel. Values of absolute voltages and thresholds are in reference to analog ground, which has a nominal bias voltage of approximately 1.25V. Nominal microphone sensitivity is around −56 dB, while nominal gains and center frequencies for each of the three acoustic channels are as follows:

| | | |
|---|---|---|
| Low-frequency: | FLXA | 48.2 dB (256x) at 22 Hz |
| Medium-frequency: | BP1A | 28.3 dB (26x) at 3.95 kHz |
| High-frequency: | BP2A | 30.1 dB (32x) at 13.5 kHz |

Properly identifying and validating a glass-breakage event initially requires meeting the conditions of a valid event trigger. The valid event trigger conditions are identical whether using signal processing methods "A" or "B". An event trigger occurs when an acoustic event is of sufficient amplitude within the medium-frequency band-pass channel BP1A, for example a signal of 93 dB SPL at 3.8 kHz, so as to exceed a predetermined threshold Trigger_Threshold of about +/−100 mV at the medium-frequency band-pass (BP1A) comparators. The trigger circuit upon recognizing the crossing raises the event trigger to bring the timer out of a reset state, whereupon all algorithmic timing is then referenced from that event trigger.

4.1. Signal Processing Method "A"

A received set of acoustical waveforms requires qualification prior to acceptance as a valid framed glass-breakage event. Qualification requires meeting each of the following criteria:

Dual-trigger=((BP2A_N or BP2A_P)>100 mV)*4<977 μS

Within the Dual_Trigger_Interval of approximately 977 μS, which commences from the event trigger, a number of pulses Dual_trigger_Min_Count, set nominally at four pulses, must be registered over the threshold BP2_Threshold, on one of the BP2 event comparators having a 100 mV absolute value threshold. If the FLEX signal is validated prior to the Dual_Trigger_Interval of approximately 977 μS, then the BP2A channel is evaluated such that the dominant portion of the incoming signal is in phase with the FLEX signal. This requirement is referred to as the high-frequency dual-trigger.

BAV validation=(BAV_VLD >100 mV)<977 μS

Within the Dual_Trigger_Interval of approximately 977 μS from the event trigger, a single threshold crossing must occur from the band-pass average voltage (BAV) comparator set with a threshold of BAV_Validation_Threshold (100 mV). This trigger requirement is referred to as BAV validation.

BAV duration=(BAV_DUR >BAV_PK/10)>4.8 ms

The BAV signal must not cross below the BAV_Duration_Threshold, which is nominally set to 10% of the peak BAV signal (thereby scaling the peak BAV signal by approximately one-tenth), during the BAV_Duration_interval which spans up to about 4.8 milliseconds from the event trigger. This requirement is referred to as BAV duration.

FLEX validation=[(FLX_N or FLX_P)>400 mV]<7.8 ms

Within a Flex_Validation_Interval, of approximately 7.8 milliseconds from the event trigger, a single threshold crossing is required from either the positive or negative flex comparators. This requirement is referred to as FLEX validation. It should be appreciated that the initial direction of FLEX is of no concern, as a valid initial flex may occur in either direction. The flex direction, however, is stored to allow for the evaluation of phase dominance for the BP1A and BP2A signals.

No Vibration (FLEX only):

vibration type 1=[ABS(PK2) and ABS(PK2')>0.35*ABS(PK1)]<9.7 ms (a disqualfier of glass-breakage)

Figure 3:
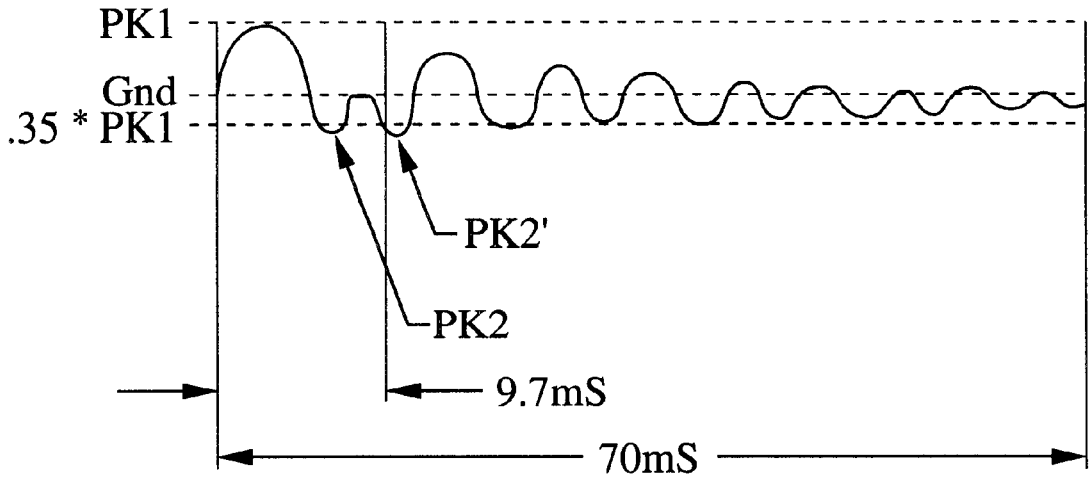
FIG. 3 is a waveform diagram commencing with a positive peak that is representative of a type 1 vibration, which is similar to an impact as defined by the ULC™ false alarm rejection standard, that is discriminated by Method "A" as a non-glass-breakage event according to an aspect of the present invention.

A type 1 vibration (non-glass-breakage event) is exemplified by the waveform of FIG. 3 shown with a signal which crests at voltage PK1 followed by a swing to negative amplitude troughs PK2 and PK2' which cross the absolute value threshold of 0.35*PK1 within a 9.7 ms timing-window.

Figure 4:
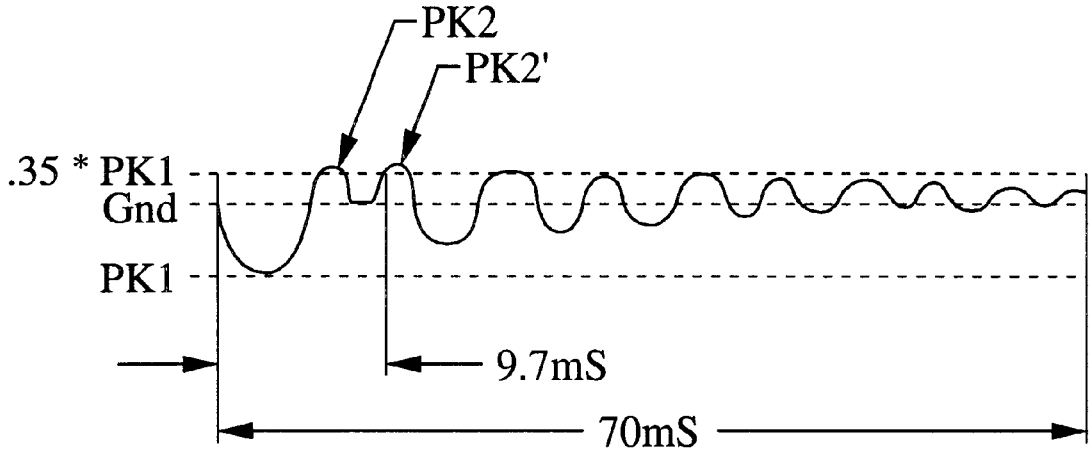
FIG. 4 is a waveform diagram commencing with a negative peak which is another representative of the type 1 vibration of FIG. 3.

For the acoustic signal to qualify as a glass-breakage event, no type 1 vibration must be present, only FLEX waveforms. This requirement is referred to as FLEX no vibration type 1. Registration as a glass-breakage event, therefore, requires that fewer than FLEX_NoVib1A_Thresh_CrossCount_Max crossings (preferably set to two) occur over the threshold FLEX_NoVib1A_ThreshPercent (preferably set to 35% of the absolute value of the first FLEX peak PK1) from the comparator (VIB_N or VIB_P) that is of the opposite polarity as the first FLEX half-cycle during a FLEX_NoVib1A_Interval (preferably of 9.7 ms). The absolute value of the first FLEX peak may be scaled by any value less than unity in performing the comparison. This requirement is referred to as FLEX, no vibration, ULC™ impact type 1. The waveform described may either be with a positive first peak, as shown by FIG. 3, or with a negative going first peak as shown in FIG. 4.

Identifying the presence of a type 1 vibration event within the present invention may be summarized as scaling the amplitude of a first peak by a scaling factor less than one to establish a threshold level, to which the amplitude of amplitude peaks following the first peak are compared. The signals are disqualified as glass breakage events if the amplitude of the second peak is greater than the threshold level and the second peak occurs within a time window initiated by detection of the contact force.

vibration type 2=[ABS(PK3>ABS(PK1) and ABS(PK4>ABS(PK1)*0.35]<70 ms (a disqualifier of glass-breakage)

BUT IF ABS(PK1) is also >800 mV (then requalifies as a glass-breakage event)

Figure 5:
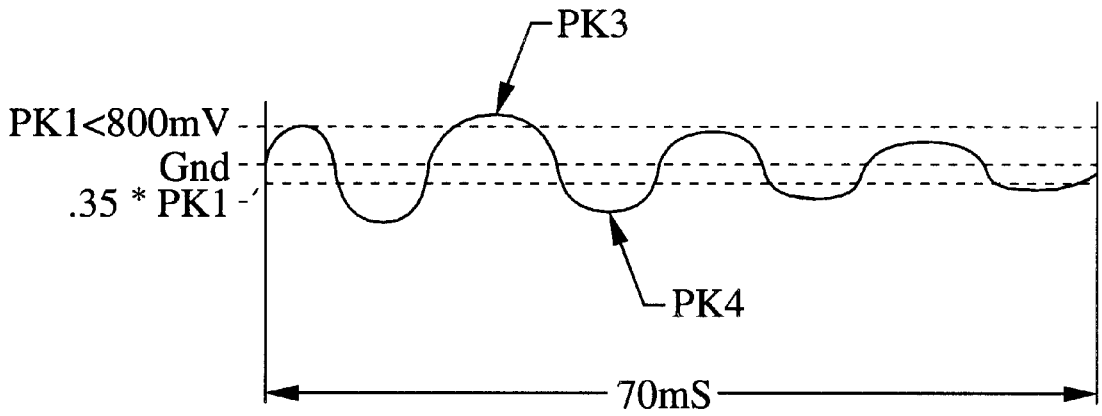
FIG. 5 is a waveform diagram commencing with a positive peak that is representative of a type 2 vibration, which is discriminated by Method "A" as a non-glass-breakage event according to an aspect of the present invention.

A type 2 vibration (non-glass-breakage event) is exemplified by the waveform of FIG. 5 shown with a signal whose first crest peaks at PK1 (which must be less than 800 mV), followed by a third crest of the same phase as the first crest that reaches a peak value of PK3 which exceeds the threshold of the first FLEX peak, PK1.

Figure 6:
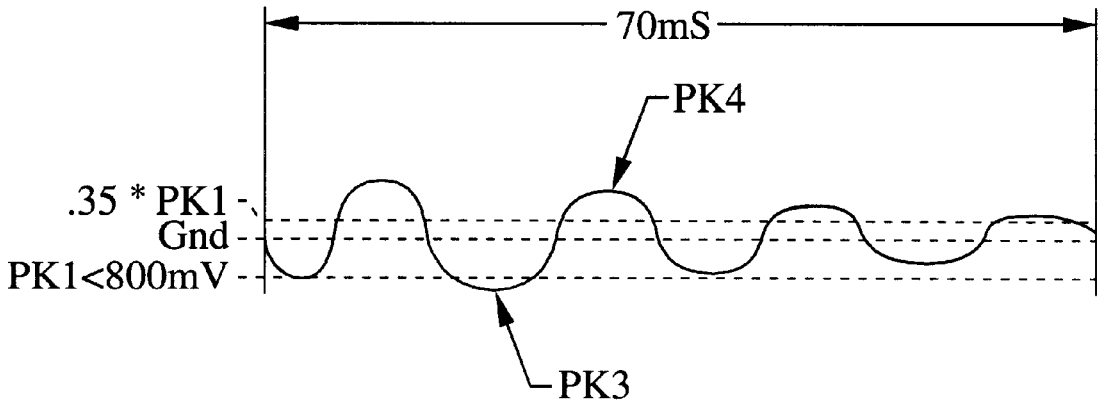
FIG. 6 is a waveform diagram commencing with a negative peak which is another representative of the type 2 vibration of FIG. 5.

For the acoustic signal to qualify as a glass-breakage event, no type 2 vibration must be present, only FLEX waveforms. This requirement is referred to as FLEX no vibration type 2. Registration as a glass-breakage event, therefore, requires that fewer than FLEX_NoVib2A_Thresh_FIxPkCrossCount_Max crossings (preferably set to one) of the same phase as the first FLEX peak, may exceed the threshold FLEX_NoVib2A_ThreshFlexPeakPercent (set nominally at 100% of the first FLEX peak) during a FLEX_NoVib2A_Interval (preferably set to approximately 70 ms from the event trigger). In addition, less than FLEX_NoVib2A_Thresh_CrossCount_Max crossings (preferably set at one), in the opposite phase as the first FLEX peak, may exceed the threshold FLEX_NoVib2A_ThreshPercent (nominally set at 35% of the absolute value of the first FLEX peak) during the same FLEX_NoVib2A_Interval. This requirement is referred to as FLEX, no vibration, type 2. The waveform described may have either a positive first peak, as shown by FIG. 5, or a negative going first peak as shown in FIG. 6.

The described type 2 vibration is considered a non-glass-breakage event unless the first half-cycle of the FLEX signal exceeds a higher predetermined threshold FLEX_HiValidationThreshold, (approximately 800 mV), in which case the vibration is allowed as a glass-breakage event, so that the detection of laminated glass-breakage is permitted while non-broken glass flexing is discriminated against.

VAC FLX=[(ABS(FLXA)>400 mV)>488 μS]<1.9 ms (and before FLEX validation)

Prior to FLEX validation, the absolute value of the FLEX signal may not exceed the FLEX_ValidationThreshold of about 400 mV, for an interval beyond VACFLX_TimeOverThresh_Max which is preferably set to about 488 μS, within a period of VACFLX_Precurse_Interval during a span of approximately 1.9 ms after the occurrence of the event trigger, which is represented as a threshold crossing from either polarity of the FLEX comparator. This requirement is referred to as the no VAC FLEX precursor.

Signal Amplitude Ratios:

Normal Amplifier Range: Medium Freq BP Signal/Flex Signal >2

Unamplified Range: Medium Freq BP Signal/Flex Signal >20

The signal amplitude ratios between the 4 kHz band-pass (BP1A) and the low-frequency (FLEX) channel must be consistent with the signal generated by the breaking of framed glass. Empirically determined ratios exist between the band-pass amplitudes in actual glass-breakage events which are checked within this validation test. Unamplified range refers to the second gain stage being switched down to a unity gain. The following two conditions need to be met to qualify the event according to signal amplitude ratios:

(a) Under a normal amplitude range of the BP1A channel, such as SPL=93 dB to 130 dB, the FLEX signal is required to be in excess of approximately 50% of the unamplified BP1A signal.

(b) Under a high amplitude event trigger, such as SPL >130 dB, generated by the BP1A channel, the unamplified FLEX signal is required to be in excess of approximately 5% of the unamplified BP1A signal.

4.2. Signal Processing Method "B"

Method "B" also provides a means of validating glass-breakage events and commences execution on the identical event trigger conditions described for use with method "A". Prior to accepting a set of acoustical waveforms as a valid framed glass-breakage event, the waveforms are required to meet each of the following criteria.

Dual-trigger=((BP2A_N or BP2A_P)>100 mV)*4<977 μS (delayed 1.9 ms)

After a Dual_Trigger_Delay_Interval of approximately 1.9 ms from the event trigger, at least Dual_trigger_Min_Count, preferably set at four pulses, must be registered over the threshold BP2_Threshold on one of the BP2 event comparators which has a 100 mV absolute value threshold within the Dual_Trigger_Interval spanning an interval of approximately 977 μS after the delay. If the FLEX signal is validated prior to the Dual_Trigger_Interval, then the BP2A channel is evaluated such that the dominant part of the incoming signal is in phase with the FLEX signal. This requirement is referred to as the high-frequency dual-trigger.

BAV validation=(BAV_VLD >100 mV)<977 μS

Within the Dual Trigger Interval, of approximately 977 μS from the event trigger, a single threshold crossing is required from the Band-pass Average Voltage (BAV) comparator having a threshold of BAV_Validation_Threshold that is approximately 100 mV. This trigger requirement is referred to as BAV validation.

BAV duration=(BAV_DUR >BAV_PK/10)>4.8 ms

The BAV signal must not drop enough to cross the BAV_Duration_Threshold, which is nominally set for about 10% of the peak BAV signal (thereby scaling the peak BAV signal by approximately one-tenth), within a BAV_Duration_interval which preferably spans 4.8 ms from the event trigger. This requirement is referred to as BAV duration.

FLEX validation=(FLX_N or FLX_P)>400 mV]<7.8 ms

Within a Flex_Validation_Interval of approximately 7.8 ms from the event trigger, a single threshold crossing is required from either the positive or negative flex comparators. This requirement is referred to as FLEX validation. It should be appreciated that the initial direction of FLEX is not a limiting concern, as a valid initial flex in either direction is acceptable. The direction of the flex signal is stored to allow subsequent evaluation of phase dominance for the BP1A and BP2A signals.

No Vibration (FLEX only):

vibration type 1=[ABS(PK2)>0.35*ABS(PK1)]<4.8 ms (a disqualifier of glass-breakage)

Figure 7:
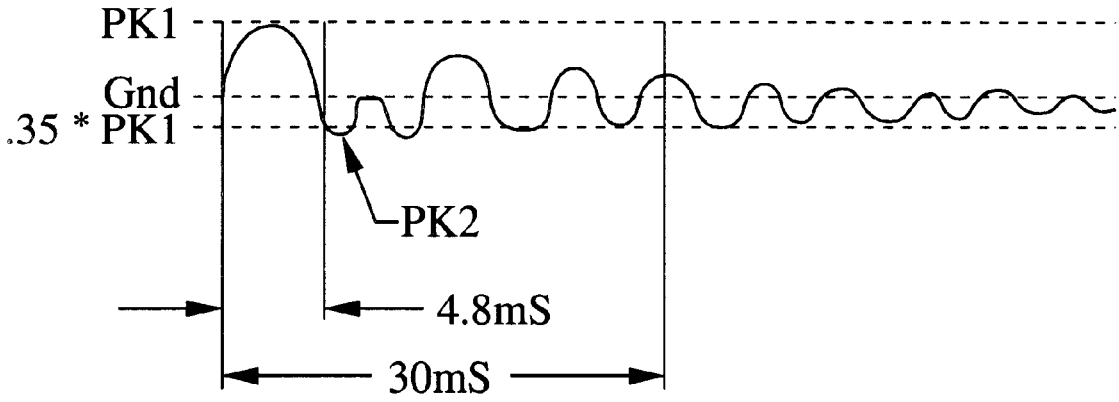
FIG. 7 is a waveform diagram commencing with a positive peak that is representative of a type 1 vibration, which is similar to an impact as defined by the ULC™ false alarm rejection standard, that is discriminated by Method "B" as a non-glass-breakage event according to an aspect of the present invention.

A type 1 vibration (non-glass-breakage event) is exemplified by the waveform of FIG. 7 shown with a signal which crests at voltage PK1 followed by a swing to a negative amplitude trough PK2 narrowly crossing the absolute value threshold of 0.35*PK1 within a 4.8 ms timing-window.

Figure 8:
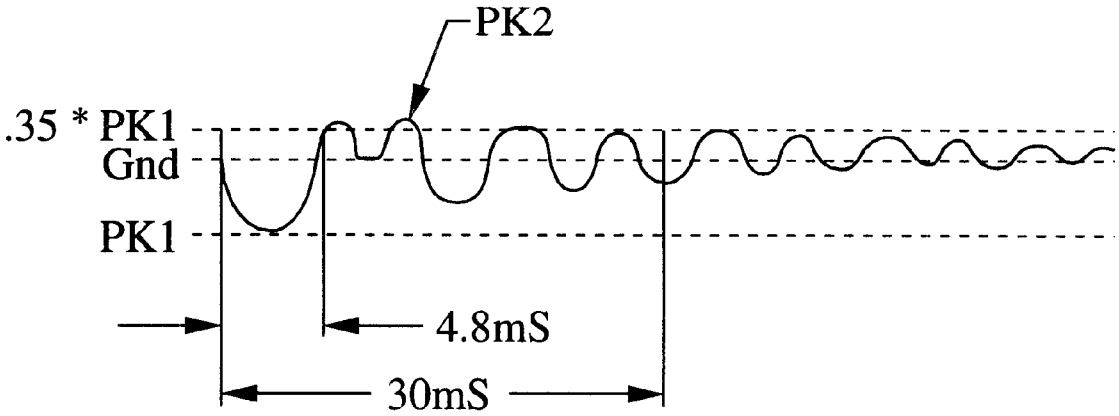
FIG. 8 is a waveform diagram commencing with a negative peak which is another representative of the type 1 vibration of FIG. 7.

For the acoustic signal to qualify as a glass-breakage event, no type 1 vibration must be present, only FLEX waveforms. This requirement is referred to as FLEX no vibration type 1. Registration as a glass-breakage event, therefore, requires that fewer than FLEX_NoVib1B Thresh_CrossCount_Max crossings (preferably set to one) occur over the threshold FLEX_NoVib1B_ThreshPercent which is equivalent to the first FLEX peak PK1 subject to scaling by a value less than unity (preferably FLEX_NoVib1B_ThreshPercent is set to 35% of the absolute value of the first FLEX peak PK1) from the comparator (VIB_N or VIB P) that is of the opposite polarity as the first FLEX half-cycle during a FLEX_NoVib1B_Interval (preferably 4.8 ms). This requirement is referred to as FLEX, no vibration, ULC™ impact type 1. The waveform described may either be with a positive first peak, as shown by FIG. 7, or with a negative going first peak as shown in FIG. 8.

vibration type 2=[ABS(PK3)>ABS(PK1) and ABS(PK4) >ABS(PK1)*0.35]<30 ms (a disqualifier of glass-breakage)

BUT IF ABS(PK1) also >800 mV (then requalifies as a glass-breakage event)

Figure 9:
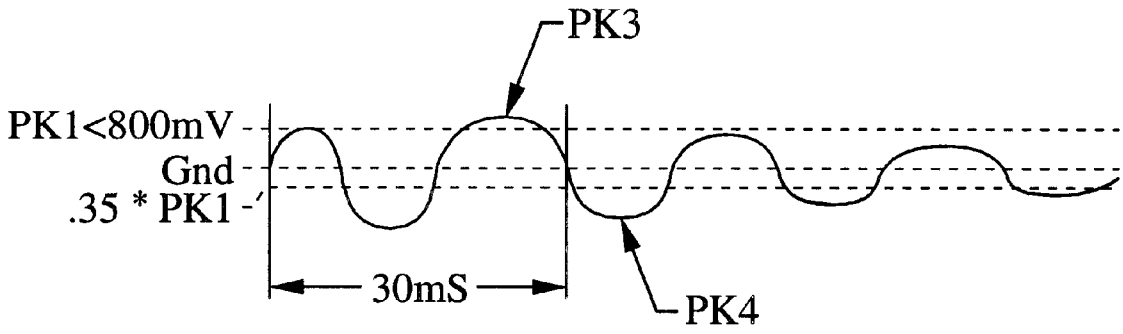
FIG. 9 is a waveform diagram commencing with a positive peak that is representative of a type 2 vibration, which is discriminated by Method "B" as a non-glass-breakage event according to an aspect of the present invention.

A type 2 vibration (non-glass-breakage event) is exemplified by the waveform of FIG. 9 shown with a signal whose first crest peaks at PK1 (which must be less than 800 mV), followed by a third crest of the same phase as the first crest that reaches a peak value of PK3 which exceeds the threshold of the first FLEX peak, PK1.

Figure 10:
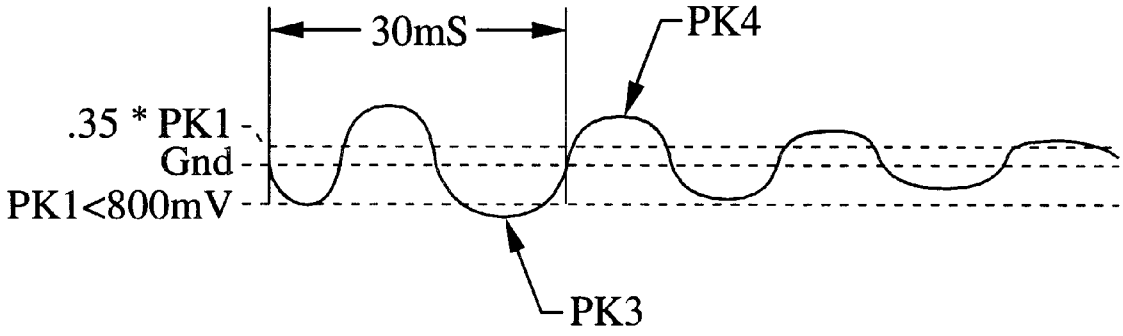
FIG. 10 is a waveform diagram commencing with a negative peak which is another representative of the type 2 vibration of FIG. 9.

For the acoustic signal to qualify as a glass-breakage event, no type 2 vibration must be present, only FLEX waveforms. This requirement is referred to as FLEX no vibration type 2. Registration as a glass-breakage event, therefore, requires that fewer than FLEX_NoVib2B_Thresh_FIxPkCrossCount_Max crossings (preferably set to one) of the same phase as the first FLEX peak, may exceed the threshold FLEX_NoVib2B_ThreshFlexPeakPercent (set nominally at 100% (full-scale) of the first FLEX peak) during a FLEX_NoVib2B_Interval (preferably set to approximately 30 Ms from the event trigger). In addition, less than FLEX_NoVib2B_Thresh_CrossCount_Max crossings (preferably set at one) of the opposite phase as the first FLEX peak, may exceed the threshold FLEX_NoVib2B_ThreshPercent, which is equivalent to the first FLEX peak PK1 subject to scaling by a value less than unity preferably set at 35% of the absolute value of the first FLEX peak) during the same FLEX_NoVib2B_Interval. This requirement is referred to as FLEX, no vibration, type 2. The waveform described may have either a positive first peak, as shown by FIG. 9, or a negative going first peak as shown in FIG. 10.

The described type 2 vibration is considered a non-glass-breakage event unless the first half-cycle of the FLEX signal exceeds a higher predetermined threshold FLEX_HiValidationThreshold, (approximately 800 mV), in which case the vibration is allowed as a glass-breakage event, so that the detection of laminated glass-breakage is permitted while non-broken glass flexing is discriminated against.

VAC FLX=[(ABS(FLXA)>400 mV >488 μS]<1.9 ms (and before FLEX validation)

The absolute value of the FLEX signal, prior to FLEX validation, may not exceed the FLEX_ValidationThreshold of about 400 mV for more than VACFLX_TimeOverThresh_Max of approximately 488 $\mu$S within a period of VACFLX_Precurse_Interval given by a period of about 1.9 ms after the occurrence of the event trigger, which is represented as a threshold crossing from either polarity of FLEX comparator. This requirement is referred to as the no VAC FLEX precursor.

Signal Amplitude Ratios:

Normal Amplifier Range: Medium Freq BP Signal/Flex Signal >2

Unamplified Range: Medium Freq BP Signal/Flex Signal >20

The signal amplitude ratios between the 4 kHz band-pass (BP1A) and the low-frequency (FLEX) channel need to be consistent with the signal generated by the breaking of framed glass. Unamplified range refers to the second gain stage being switched down to a unity gain. The following two conditions must be met in order to qualify the event by signal amplitude ratios:

(a) Under a normal amplitude range of the BP1A channel (such as SPL=93 dB to 130 dB) the FLEX signal is required to exceed approximately 50% of the unamplified BP1A signal.

(b) Under a high amplitude event trigger (such as SPL >130 dB) from the BP1A channel, the unamplified FLEX signal is required to exceed approximately 5% of the unamplified BP1A signal.

Accordingly it will be seen that the present invention of a glass-breakage detector and method of discriminating glass flexing provides an implementation and methods for the discrimination of breakage events registered by one or more acoustic transducers which detect an acoustic wave resulting from a contact force applied to the surface of the glass. Numerous alternative embodiments can be implemented using various circuit technologies without departing from the underlying principles. For example, the hardware may comprise differing mixes of analog and digital hardware. The functions described may also be partitioned differently across various numbers of integrated circuits or discrete elements. In addition, the components, measurement values, and thresholds can be widely varied without departing from the inventive concepts. It will be appreciated that specified signal levels and thresholds within the description coincide with the specific characteristics of the described circuit elements, a wide variation of parameters may therefore be accommodated with according changes to the circuit which will be obvious to one of ordinary skill in the art.

Although the description above contains many specificities, these should not be construed as limiting the scope of the invention, but as merely providing illustrations of some of the presently preferred embodiments of this invention. Thus, the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited din the claims. No claim element herein is to be construed under the provisions of 35 U.S.C. 112, sixth paragraph, unless the element is expressly recited using the phrase "means for."

TABLE 1

List of Acronyms

| Acronym | Definition |
|---|---|
| BAV | Band-pass average voltage of envelope. |
| BAVA | Amplified band-pass average voltage of envelope. |
| BAVA_DUR | Amplified band-pass average voltage of envelope duration indicator. |
| BAVA_PK | Amplified band-pass average voltage of envelope peak. |
| BP1A | Band-pass 1 amplifier stage one. |
| BP1B | Band-pass 1 amplifier stage two. |
| BP2A | Band-pass 2 amplifier stage one. |
| BP2B | Band-pass 2 amplifier stage two. |
| FLX | Flex (low-frequency) signal. |
| FLXA | Amplified flex (low-frequency) signal or flex amplifier stage one. |
| FLXB | Flex amplifier stage two. |
| VIBPK | Vibration peak. |
| VIB | Vibration indicator. |

TABLE 2

Tri-state Mode Input States

| Input | Action or Result |
|---|---|
| High | Both attenuator capacitors switched out |
| High-Z | 1st attenuator capacitor switched in (1.6–2.0 dB) |
| Low | 2nd attenuator capacitor switched in (3.5–4.0 dB) |

TABLE 3

Tri-state Mode Input States

| Input | Action or Result |
|---|---|
| High | Zone mode |
| High-Z | Normal Sensitivity |
| Low | Sensitivity reduced 3 dB |

TABLE 4

LED Control Input States

| Input | Action or Result |
|---|---|
| High | LEDs Disabled |
| High-Z | Smart Setup processing/LED's Enabled |
| Low | LEDs Enabled |

TABLE 5

| Latch Control Input States | |
|---|---|
| Input | Action or Result |
| High | Hardwired mode/alarm LED non-latching |
| High-Z | Wireless mode/alarm LED non-latching |
| Low | Hardwired mode/alarm LED latching |

TABLE 6

| LED States within the System | | |
|---|---|---|
| Condition | Green LED | Red LED |
| Normal | OFF | OFF |
| Normal, event detected | Flicker | OFF |
| Normal, event detected, alarm in memory. | Flicker | Flash = 5 seconds |
| Normal, break detected | OFF | ON = 5 seconds |
| Power-up self-test | ON = 1 second | ON = 1 second |
| Trouble detected | Flash 1/second | Flash 1/second alternating |
| Low battery | Flash 1/second | Flash 1/second |
| Test mode | Flash 1/second | OFF |
| Test mode, event detected | Flicker | OFF |
| Test mode, alarm | Flash 1/second | ON = 5 seconds |

What is claimed is:

1. An apparatus for detecting the breaking of a contact-sensitive surface, comprising:

(a) an acoustic transducer;

(b) a detector circuit responsive to the transducer for detecting an acoustic wave resulting from a contact force applied to the surface and generating a signal representing said acoustic wave, said signal having a plurality of consecutive amplitude peaks of the same or opposite phases; and (c) means for (i) scaling the amplitude of a first peak by a scaling factor less than one to establish a threshold level;

(ii) comparing the amplitude of a amplitude peak following said first peak to the threshold level; and (iii) disqualifying the contact force as a breakage event if the amplitude of the second peak is greater than the threshold level and the second peak occurs within a time window initiated by detection of the contact force.

2. An apparatus as recited in claim 1, further comprising means for (a) comparing the amplitude of a third peak following the second peak with the amplitude of the first peak;

(b) comparing the amplitude of a fourth peak following the third peak with the threshold level; and (c) disqualifying said contact force as a glass break if the amplitude of the third peak is greater than the amplitude of the first peak and the amplitude of the fourth peak is greater than the threshold within a second time window initiated by detection of the contact force.

3. An apparatus as recited in claim 2, further comprising means for comparing the amplitude of the first peak with a second threshold and not carrying out the step of disqualifying the contact force as a glass break if the amplitude of the third peak is greater than the amplitude of the first peak and the amplitude of the fourth peak is greater than the threshold within the second time window.

4. An apparatus as recited in claim 2, wherein the second time window is approximately 70 milliseconds or less.

5. An apparatus as recited in claim 1, wherein the time window is approximately 9.7 milliseconds or less.

6. An apparatus as recited in claim 1, wherein said contact sensitive surface comprises framed glass.

7. An apparatus as recited in claim 1, wherein said scaling comprises a scaling factor of approximately 0.35.

8. An apparatus for detecting the breaking of a contact-sensitive surface, comprising:

(a) an acoustic transducer;

(b) a detector circuit responsive to the transducer for detecting an acoustic wave resulting from a contact force applied to the surface and generating a signal representing the acoustic wave, said signal having a plurality of consecutive amplitude peaks of the same or opposite phases; and (c) means for (i) scaling the amplitude of the first peak by a scaling factor less than one to establish a threshold level;

(ii) comparing the amplitude of a third peak following a second peak with the amplitude of a first peak preceding the second peak;

(iii) comparing the amplitude of a fourth peak following the third peak with the threshold level; and (iv) disqualifying the contact force as a breakage event if the amplitude of the third peak is greater than the amplitude of the first peak and the amplitude of the fourth peak is greater than the threshold within a time window initiated by detection of the contact force.

9. An apparatus as recited in claim 8, further comprising means for comparing the amplitude of the first peak with a second threshold and not carrying out the step of disqualifying the contact force as a breakage event if the amplitude of the third peak is greater than the amplitude of the first peak and the amplitude of the fourth peak is greater than the threshold within the time window.

10. An apparatus as recited in claim 8, further comprising means for:

(a) comparing the amplitude of the second peak to the threshold level; and (b) disqualifying the contact force as a breakage event if the amplitude of the second peak is greater than the threshold level and the second peak occurs within a second time window initiated by detection of the contact force.

11. An apparatus as recited in claim 10, wherein the second time window is approximately 9.7 milliseconds or less.

12. An apparatus as recited in claim 8, wherein the time window is approximately 70 milliseconds or less.

13. An apparatus as recited in claim 8, wherein said contact sensitive surface comprises framed glass.

14. An apparatus as recited in claim 8, wherein said scaling of the amplitude comprises utilizing a scaling factor of approximately 0.35.

15. A method for detecting the breaking of a contact-sensitive surface, comprising:

(a) providing an acoustic transducer;

(b) providing a detector circuit responsive to the transducer for detecting an acoustic wave resulting from a contact force applied to the surface and generating a signal representing said acoustic wave, said signal having a plurality of consecutive amplitude peaks of the same or opposite phases;

(c) scaling the amplitude of a first peak by a scaling factor less than one to establish a threshold level;

(d) comparing the amplitude of a amplitude peak following said first peak to the threshold level; and (e) disqualifying the contact force as a breakage event if the amplitude of the second peak is greater than the threshold level and the second peak occurs within a time window initiated by detection of the contact force.

16. A method as recited in claim 15, further comprising:

(f) comparing the amplitude of a third peak following the second peak with the amplitude of the first peak;

(g) comparing the amplitude of a fourth peak following the third peak with the threshold level; and (h) disqualifying said contact force as a breakage event if the amplitude of the third peak is greater than the amplitude of the first peak and the amplitude of the fourth peak is greater than the threshold within a second time window initiated by detection of the contact force.

17. A method as recited in claim 16, further comprising comparing the amplitude of the first peak with a second threshold and not carrying out the step of disqualifying the contact force as a breakage event if the amplitude of the third peak is greater than the amplitude of the first peak and the amplitude of the fourth peak is greater than the threshold within the second time window.

18. A method as recited in claim 16, wherein the second time window is approximately 70 milliseconds or less.

19. A method as recited in claim 15, wherein the time window is approximately 9.7 milliseconds or less.

20. A method as recited in claim 15, wherein said contact sensitive surface comprises framed glass.

21. A method as recited in claim 15, wherein said scaling comprises applying a scaling factor of approximately 0.35.

22. A method for detecting the breaking of a contact-sensitive surface, comprising:

(a) providing an acoustic transducer;

(b) providing a detector circuit responsive to the transducer for detecting an acoustic wave resulting from a contact force applied to the surface and generating a signal representing the acoustic wave, said signal having a plurality of consecutive amplitude peaks of the same or opposite phases;

(c) scaling the amplitude of the first peak by a scaling factor less than one to establish a threshold level;

(d) comparing the amplitude of a third peak following a second peak with the amplitude of a first peak preceding the second peak;

(e) comparing the amplitude of a fourth peak following the third peak with the threshold level; and (d) disqualifying the contact force as a breakage event if the amplitude of the third peak is greater than the amplitude of the first peak and the amplitude of the fourth peak is greater than the threshold within a time window initiated by detection of the contact force.

23. A method as recited in claim 22, further comprising comparing the amplitude of the first peak with a second threshold and not carrying out the step of disqualifying the contact force as a breakage event if the amplitude of the third peak is greater than the amplitude of the first peak and the amplitude of the fourth peak is greater than the threshold within the time window.

24. A method as recited in claim 22, further comprising:

(e) comparing the amplitude of the second peak to the threshold level; and (f) disqualifying the contact force as a breakage event if the amplitude of the second peak is greater than the threshold level and the second peak occurs within a second time window initiated by detection of the contact force.

25. A method as recited in claim 24, wherein the second time window is approximately 9.7 milliseconds or less.

26. A method as recited in claim 22, wherein the time window is approximately 70 milliseconds or less.

27. A method as recited in claim 22, wherein said contact sensitive surface comprises framed glass.

28. A breakage detection apparatus for use with acoustical transducers to detect panel breakage, comprising:

(a) an acoustic signal processing circuit capable of receiving a signal from a first acoustical transducer which includes transducer amplifying and conditioning circuitry and is capable of measuring signal amplitudes and relationships within a set of pass-bands, wherein at least one of said pass-bands compares signal excursions within said pass-band to a scaled version of the previously detected peak of said signal excursion; and (b) a timing control circuit that commences sequence timing of a validation interval upon a sufficient signal threshold excursion and controls the acoustic signal processing circuit to validate a breakage event upon suitable waveform conditions being met whereupon a valid alarm is signaled.

29. An apparatus as recited in claim 28, wherein measurements of signal characteristics may be performed within at least three pass-bands.

30. An apparatus as recited in claim 29, wherein the three pass-bands are supported with a high frequency pass-band having a center frequency of approximately 13.5 kilohertz, a medium-frequency pass-band having a center frequency of approximately 4 kilohertz, and a low-frequency pass-band having a center frequency of approximately 22 hertz.

31. An apparatus as recited in claim 28, wherein a low-frequency processing section, being one of said pass bands, within the acoustic signal processing circuit comprises at least one peak detector and an amplitude comparator adapted for comparing a scaled version of a peak registered by said peak detector with signal excursions within said pass-band.

32. An apparatus as recited in claim 28, wherein a medium-frequency processing section within the acoustic signal processing circuit comprises at least one amplitude comparator, and at least one peak detector.

33. An apparatus as recited in claim 32, wherein the a medium-frequency processing section further includes an event comparator whose output may be used for the event trigger which initiates event timing within the circuit.

34. An apparatus as recited in claim 28, wherein a high-frequency processing section within the acoustic signal processing circuit comprises at least one envelope follower.

35. An apparatus as recited in claim 34, wherein the high-frequency processing section comprises at least one amplitude comparator.

36. An apparatus as recited in claim 28, further comprising an input for a second transducer input on a second transducer input conditioning circuit, which is connected with the acoustic signal processing circuit to thereby provide for time of arrival processing of the acoustic event waveforms.

37. An apparatus as recited in claim 28, further comprising an LED logic and driver circuit that drives a set of external light emitting diodes for the display of status information.

38. An apparatus as recited in claim 28, further comprising a low voltage detector circuit for measuring the system voltage and signaling the alarm logic upon excessive voltage excursions which could indicate problems within the system.

39. An apparatus as recited in claim 28, further comprising a test mode decode logic circuit wherein a signal triggers the device into a test mode during which various tests of the circuitry are facilitated.

40. An apparatus as recited in claim 28, further comprising a self-test logic circuit that allows the testing of the apparatus by routing signals through the transducer amplifying and conditioning circuitry and thereby testing circuit responses of the various signal processing, timing, and logic sections.

41. An apparatus as recited in claim 28, further comprising a programmable bias current generator whose output current levels are used for biasing analog components within the acoustic signal processing circuit to provide multiple modes of operation.

42. An apparatus as recited in claim 28, further comprising a gain control circuit for the transducer amplifying circuitry which provide a choice of amplification levels applied to the acoustical transducer signals.

43. An apparatus as recited in claim 28, wherein the circuitry is contained within a mixed-signal application-specific integrated circuit (ASIC).

44. An apparatus as recited in claim 28, wherein said panel-breakage comprises the breakage of framed glass.

45. The apparatus as recited in claim 28, wherein said scaled version of the previously detected peak comprises a version of said previously detected peak which has been scaled by multiplying it by approximately 0.35.

46. A method of validating a panel-breakage event from acoustical signals generated by transducers which are received within an acoustical processing circuit, comprising the steps of:

(a) registering a predetermined minimum number of waveform cycles within a high-frequency pass-band above a first threshold which follows within a first interval after an event trigger;

(b) maintaining a sufficient average signal amplitude within a predetermined second interval following the event trigger;

(c) registering a low-frequency component of the signal having a first peak exceeding a second threshold and wherein less than a predetermined number of additional peaks may exceed a predetermined percentage of the first peak amplitude during a third interval, while not exceeding the amplitude of the first peak in the same phase or subsequently exceeding the predetermined percentage of the first peak amplitude in the opposite phase, the low-frequency component diminishing below a specified voltage threshold during a specified fourth interval; and (d) registering signal ratios of low-frequency signal component (flex) which exceed a specified percentage of a medium-frequency signal component.

47. A method as recited in claim 46, wherein the acoustical processing circuit processes signals according to at least three pass-bands.

48. A method as recited in claim 47, wherein three pass-bands are provided as high, medium, and low frequency.

49. A method as recited in claim 48, wherein the high frequency pass-band is configured for a center frequency of approximately 13.5 kilohertz, the medium-frequency pass-band is configured for a center frequency of approximately 4 kilohertz, and a low-frequency pass-band is configured for a center frequency of approximately 22 hertz.

50. A method as recited in claim 46, wherein the minimum sufficient number of absolute value waveform peaks during the first interval is set to four.

51. A method as recited in claim 46, wherein the predetermined second interval following the event trigger in which to receive a sufficient average signal amplitude is configured for approximately 977 microseconds.

52. A method as recited in claim 46, wherein the predetermined number of additional peaks is set at two when the third interval is configured to approximately 9.7 milliseconds, and is set at one when the third interval is configured for approximately 4.8 milliseconds.

53. A method as recited in claim 46, wherein the specified percentage of the medium-frequency signal component is dependent on the medium-frequency amplitude range.

54. A method as recited in claim 53, wherein the specified percentage under a normal amplitude range is configured for 50% while the specified percentage under high-amplitude conditions is configured for 5%.

55. A method as recited in claim 54, wherein the normal amplitude is of a medium-frequency signal component in the range of 93 decibels to 130 decibels, while the high-amplitude condition is of a medium-frequency signal component exceeding approximately 130 decibels.

56. A method as recited in claim 46, wherein the fourth interval is configured for approximately 70 milliseconds.

57. A method as recited in claim 46, wherein the event trigger occurs upon receiving a signal exceeding approximately 93 decibels.

58. A method as recited in claim 46, wherein said panel-breakage comprises the breakage of framed glass.

59. A method as recited in claim 46, wherein said predetermined percentage of said first peak amplitude comprises 35%.

60. A method as recited in claim 46:

wherein said first interval spans approximately 1.9 milliseconds;

wherein said second interval spans approximately 4.8 milliseconds;

wherein said third interval spans approximately 7.8 milliseconds; and wherein said fourth interval spans approximately 9.7 milliseconds.

61. A method as recited in claim 46, wherein said registering of said signal ratios are performed over an interval of approximately 30 milliseconds.

62. A method as recited in claim 46, wherein during said first interval after said event trigger the absolute value of the signal may not exceed a given threshold value for a given maximum period of time.

63. A method as recited in claim 62, wherein said threshold value comprises approximately 400 milliseconds and said given maximum period of time comprises approximately 488 microseconds.

64. A method of validating a panel-breakage event within an acoustical detector circuit which processes acoustical signals in each of at least three pass-bands, comprising the steps of:

(a) qualifying a trigger event within a medium-frequency pass-band having an amplitude which exceeds an event threshold and commencing to time an event interval;

(b) registering a minimum sufficient number of crossings of the absolute value of the signal over a dual-trigger threshold within a high-frequency pass-band during a dual-trigger interval within the event interval;

(c) maintaining a sufficient average absolute signal level during the event interval;

(d) registering a crossing from the absolute value of low-frequency flex signal over a flex threshold within a flex interval within the event interval and recording the phase of the signal;

(e) registering within a first vibration interval less than two crossings of a threshold which is set approximately equal to 35% of the absolute value of the first low-frequency flex peak of opposite polarity to the recorded phase of the flex signal to discriminate impacts;

(f) maintaining within a second vibration interval a flex signal level below the amplitude of the same polarity as the recorded phase of the first flex signal peak and below a threshold of about 35% of first flex signal peak in the opposite polarity of the recorded signal phase to discriminate impacts;

(g) maintaining a low-frequency flex signal amplitude below a flex validation threshold for a period of less than a maximum flex interval within a validation interval within the event interval;

(h) maintaining signal amplitude ratios between the medium-frequency pass-band and the low-frequency flex signal that are consistent with that of a breaking panel; and (i) termination of the event interval and communicating a valid panel-breakage alarm if the above conditions have been met.

65. A method as recited in claim 64, wherein the detector is configured with a low-frequency pass-band having a center frequency of approximately 22 hertz, a medium-frequency pass-band having a center frequency of approximately 4 kilohertz, and a high-frequency pass-band having a center frequency of approximately 13.5 kilohertz.

66. A method as recited in claim 64, wherein the dual-trigger interval is configured to approximately 977 microseconds and the dual-trigger minimum crossing count value is set to four.

67. A method as recited in claim 64, wherein the first vibration interval in which the absolute value crossing is registered is configured for approximately 7.8 milliseconds from the trigger event.

68. A method as recited in claim 64, wherein the second vibration interval spans approximately 70 milliseconds from the event trigger.

69. A method as recited in claim 64, wherein the maximum flex interval is configured for approximately 488 microseconds within a validation interval commencing from the trigger event spanning approximately 1.9 milliseconds.

70. A method as recited in claim 64, wherein said panel-breakage comprises the breakage of framed glass.

* * * * *